US007268759B2

(12) United States Patent
Hsu

(10) Patent No.: US 7,268,759 B2
(45) Date of Patent: Sep. 11, 2007

(54) DRIVING METHOD OF LIQUID CRYSTAL DISPLAY

(75) Inventor: Horng-Bin Hsu, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 332 days.

(21) Appl. No.: 10/604,822

(22) Filed: Aug. 20, 2003

(65) Prior Publication Data

US 2004/0257324 A1 Dec. 23, 2004

(30) Foreign Application Priority Data

Jun. 17, 2003 (TW) ..... 92116357 A

(51) Int. Cl.
*G09G 3/36* (2006.01)

(52) U.S. Cl. ..... 345/89; 345/97; 345/98; 345/102

(58) Field of Classification Search ..... 345/89, 345/97–98, 102
See application file for complete search history.

(56) References Cited

U.S. PATENT DOCUMENTS 6,809,717 B2 * 10/2004 Asao et al. ..... 345/102
2004/0071363 A1 * 4/2004 Kouri et al. ..... 382/276

FOREIGN PATENT DOCUMENTS

JP 11-109317 * 4/1999

* cited by examiner

*Primary Examiner*—Richard Hjerpe
*Assistant Examiner*—Leonid Shapiro
(74) *Attorney, Agent, or Firm*—Jianq Chyun IP Office

(57) ABSTRACT

A driving method of a liquid crystal display is described. The driving method of liquid crystal display firstly detects the maximum grayscale of all pixel of liquid crystal display, and adjusts the out-put brightness of back-light modules in order to provide the corresponding brightness to the pixels of the maximum grayscale. Meanwhile, adjust all grayscale values of all pixels to map a new grayscale value, and drive each pixel. This driving method of this crystal display provides a sharp display quality when displaying darker image, and further reduces power consumption, particularly when displaying low brightness images.

5 Claims, 2 Drawing Sheets

DRIVING METHOD OF LIQUID CRYSTAL DISPLAY

CROSS REFERENCE TO RELATED APPLICATIONS

This application claims the priority benefit of Taiwan application serial no. 92116357, filed Jun. 17, 2003.

BACKGROUND OF INVENTION

1. Field of Invention

The present invention relates to a driving method of a liquid crystal display. More particularly, the present invention relates to a driving method capable of both retaining sharp imagery and saving power consumption.

2. Description of Related Art

As semiconductor devices and human machine display proceed, multi-media industry makes progress significantly. As to display device, a Cathode Ray Tube, CRT, display has monopolized the display device market for years for its superior display quality and its economical characteristic. However, as multi-terminal/display personal station is popular and as environmental issue is in demand, a CRT display is still under dispute for spatial usage and energy consumption reasons. It is apparent that a CRT display does not meet low power requirement and the demand of lightness, thinness, shortness and handiness. Thus a sharp imagery, space efficient, low power consumption, and radiation-free display, i.e. a liquid crystal display, LCD, is taking the lead.

A LCD image is composed of an array of pixels, and the brightness of each pixel is driven by the brightness of the back-light module as well as a grayscale value of the pixel. The present common driving method is to operate the back-light module at a constant brightness, and manipulate the bias voltage to twist each liquid crystal of the pixel; the phases of nematics of the liquid crystal thus determine light transmittance in order to display grayscale.

FIG. 1 illustrates a profile showing light transmittance of a pixel vs. bias voltage. Referring to FIG. 1, each pixel of a LCD is attacked by poor grayscale display. This poor performance is usually considerable in bright image (high grayscale) and, particularly, in dark image (low grayscale) regions. Besides, there is similar performance in higher light transmittance region, yet human eyes are less sensitive to grayscale when exposing to higher brightness.

When a LCD displays in the dark image region, the light transmittance of a liquid crystal molecule varies insignificantly as opposed to other display regions for the physical characteristic per se. Therefore, when the maximal brightness of an image is low, i.e. located in low grayscale display region, the available grayscale values are apparently not sufficient to display the entire image, and poor image quality is thus incurred.

SUMMARY OF INVENTION

As embodied and broadly described herein, the invention provides a driving method of Liquid Crystal Display, LCD, so that a LCD offers a sharp image quality and consumes low power while displaying low grayscale image.

To accomplish foregoing object, this invention provides a LCD driving method so that low grayscale imagery survives to display as well as to show a sharp image and to save power consumption. This driving method is valid for driving a LCD comprising of a back-light module and a LCD panel wherein the LCD panel having a plurality of pixels. According to this LCD driving method, a maximum grayscale X is detected among all the pixels, and the out-put brightness of back-light module is adjusted to a value $(X/N)\times L$. In this statement, N is the highest grayscale of the display system, i.e. 255 of 8-bit display system, and L is the brightness of the back-light module corresponding to the grayscale value N. Then adjust the grayscale value Xa of each pixel to a new mapping value Xb to drive the corresponding pixel.

The mapping correlation between Xa and Xb is a linear function following the equation $Xb=(Xa/X)\times N$. Notice that the correlation between Xa and Xb could be nonlinear. Furthermore, the bias voltage to each pixel is based on the grayscale value Xb, so that light transmittance is adjusted accordingly.

According to the foregoing statement, the invention further provides a driving method of LCD deploying a more efficient mapping formula, the method comprising a back-light module and a LCD panel wherein the LCD panel having a plurality of pixels. The driving method of this LCD is to divide the grayscale values 0, 1, 2, . . . , N into multiple segmentsp9p9, where N is the highest grayscale of the image display system, i.e. 255 of 8-bit image display system. Detect the maximum grayscale X among all pixels, and adjust the brightness of the back-light module to a value $(Y/N)\times L$, where Y is the upper limit of a segment in which X is located and L is corresponding brightness of the grayscale value N of the back-light module. Also adjust the grayscale value Xa of each pixel to a new mapping value Xb to drive the corresponding pixel.

As to the linear mapping relation between grayscale value Xa and grayscale value Xb, it follows the formula $Xb=(Xa/Y)\times N$. Notice that the mapping correlation between grayscale Xa and grayscale Xb could be replaced with nonlinear correlation. All of the grayscale segments may not contain the same number of grayscales. Besides, when the maximum grayscale value X of the next image differs insignificantly from the maximum grayscale value X of the present image, the output brightness of the back-light module may retain unchanged while displaying next image. For example, the back-light module retain its brightness when the maximum grayscale value X of next image is located between the present grayscale value Y to Y+S or between Z S to Z, where Z is the lower limit of the grayscale segment in which X is located and S is the predetermined threshold. Furthermore, the voltage bias that controls the transmittance of each pixel is determined by the value of Xb.

What is to be emphasized is the output brightness of the back-light module is adjusted according to what present maximum grayscale X requires. The power consumption of the back-light module is thus saved. In addition, all grayscale values of pixels among the images are rearranged according to the present maximum grayscale that is in demand, the image quality is thus guaranteed even the images are under low brightness.

These and other objects, features and advantages of the present invention will become apparent from the following detailed description of illustrative embodiments thereof, which is to be read in connection with the accompanying drawings.

It is also to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

First Preferred Embodiment

Providing a first preferred embodiment of the present invention, the Liquid Crystal Display, LCD, comprises a back-light module and a LCD panel, wherein the brightness of the back-light module is adjustable. The LCD panel has a plurality of pixels which is capable of displaying grayscale values in the range 0, 1, 2, . . . , N, where N is 255 in a 8-bit image display system, for example. The grayscale value 0 indicates the lowest brightness of pixels, whereas the larger the grayscale value is, the higher the brightness is, i.e. N indicates the highest brightness of pixels. The driving method of liquid crystal display as following description is about processing an image in a single frame, and the same method applies to each image of each frame accordingly. It is apparent for all skilled in the art that all images are not necessary driven by the gray level mapping method of this present invention. For instance, under brighter mode (high maximum grayscale) the target image manages to be selectively driven by the method of this present invention.

Figure 1:
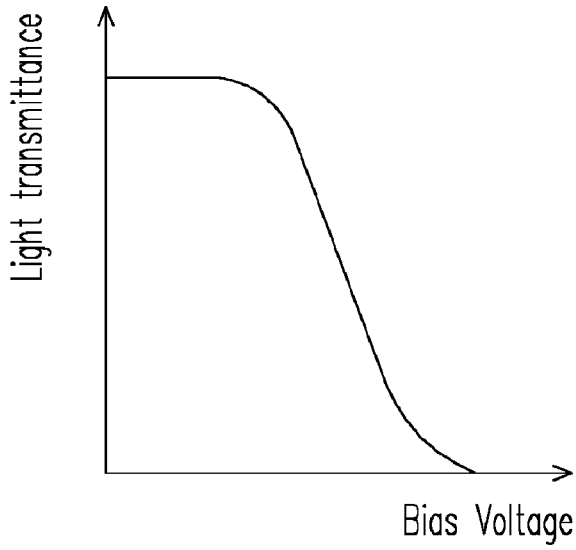
FIG. 1 is a schematic profile for light transmittance of pixels vs. bias voltage.
Figure 2:
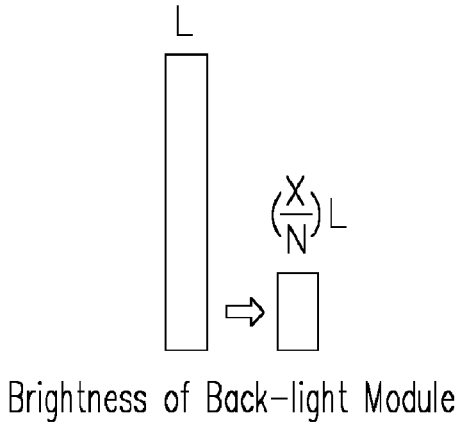
FIG. 2 illustrates a diagram of the back-light module according the first preferred embodiment of this invention.
Figure 3:
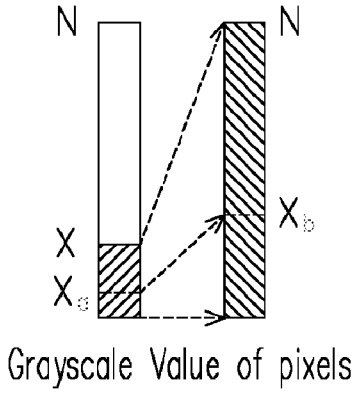
FIG. 3 illustrates a diagram of the grayscale values of the pixels according to the first preferred embodiment of this invention.

Firstly, the output brightness of the back-light module is determined according to the detected maximum grayscale X of all pixels. Referring to FIG. 2, the brightness of backlight module is then adjusted to a value of (X/N)×L. In the statement, L is the brightness of the back-light module corresponding to the grayscale value N. FIG. 3 illustrates a diagram of grayscale values of pixels in this first preferred embodiment of the present invention. Referring to FIG. 3, all grayscale values from 0, 1, 2, . . . , X are redistributed simultaneously in the range from 0 to N, so that a prior grayscale value Xa is mapped to a grayscale value Xb as the new driving value.

The linear relation between the grayscale value Xa and Xb follows the formula Xb=(Xa/X)×N thus evenly redistribute the grayscale values 0, 1, 2, . . . , X to the range from 0 to N. It is also valid to correlate Xa and Xa with a nonlinear function. In addition, the bias voltage of each pixel is determined by the grayscale value Xb so that the light transmittance of each pixel is adjusted accordingly.

Second Preferred Embodiment

Figure 4:
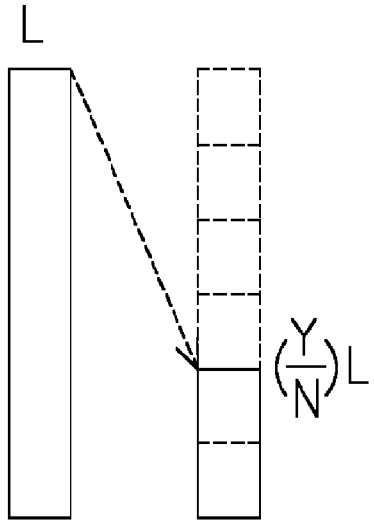
FIG. 4 illustrates a diagram of the back-light module according the second preferred embodiment of this invention.
Figure 5:
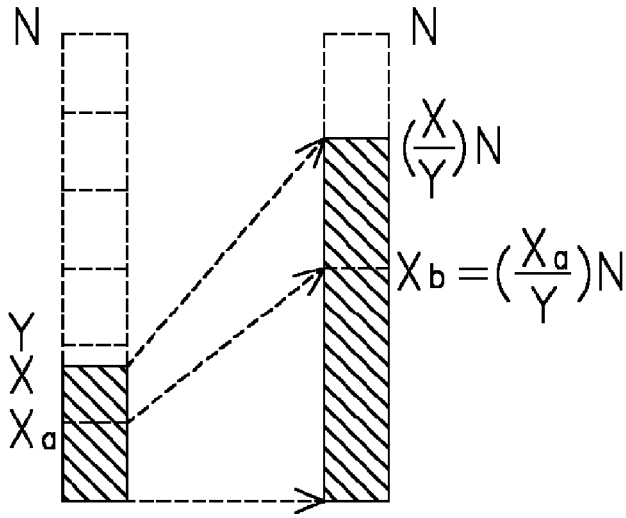
FIG. 5 illustrates a diagram of the grayscale values of the pixels according to the second preferred embodiment of this invention.

Providing a second preferred embodiment p21p21 of the present invention, the LCD driving method is identical to the first preferred embodiment of the present invention except the calculation of grayscale values is simplified, and is described as follows. The grayscale values 0, 1, 2, . . . , N is divided into multiple segments, and the brightness of the back-light module is divided into a plurality of values corresponding to the grayscale segments respectively. Notice that N is the highest grayscale of the image display system. FIG. 4 illustrates a diagram of the back-light module according the second preferred embodiment of this invention. Referring to FIG. 4,the maximum grayscale X of the present image is detected to determine the brightness of back-light module so that the brightness of back-light module is adjusted to a new value (Y/N)×L accordingly. Wherein Y is the upper limit of the grayscale segment in which X is located, and L is the corresponding brightness of the back-light module to grayscale value N. The reason for setting the brightness of back-light module to a value (Y/N)×L is to ensure the back-light module is capable of providing a corresponding brightness to the maximum grayscale X when X equals to Y. FIG. 5 illustrates a diagram of grayscale values of pixels in this second preferred embodiment of the present invention. Referring to FIG. 5, the grayscale values of pixels from 0 to X are redistributed from 0 to (X/Y)×N so that the original grayscale value Xa is mapped to Xb to drive each pixel thereafter.

Although the correlation between grayscale value Xa and Xb is a linear function Xb=(Xa/Y)×N, and all grayscale values of pixels from 0, 1, 2, . . . , X are redistributed to a range from 0 to (X/Y)×N, Xa and Xb can also be correlated with a nonlinear function. Similarly, despite the grayscales are evenly divided into the segments, it is also desirable to make an uneven division in order to sharpen the image under low brightness (e.g., make more divisions in lower grayscale region.) Additionally, in order to fix the problem that a LCD user is aware of image jittering as the brightness of back-light module is frequently switched, a buffered division solution is purposed accordingly. When the maximum grayscale X of the next image differs insignificantly from the grayscale maximum of the present image, the back-light module retains its output brightness. The criteria is, for example, the maximum grayscale X of the next image is located in either the range between Y and Y+S or the range Z S to Z, where Z is the lower limit of the segment in which X is located and S is the predetermined threshold.

Conclusively, according to the driving method of LCD in the present invention, the purpose to save power consumption of a LCD device is realized by adjusting brightness of back-light module upon the maximal brightness of all pixels in the displayed image. In addition, a sharper image is obtained under low brightness by redistributing grayscale values for displaying low brightness image with more grayscale values. Moreover, the calculation of grayscale values is simplified by dividing grayscale values in multiple segments in this LCD driving method. Ultimately, the preferred buffered division method avoids image jittering problem caused by frequent brightness switch of back-light module, so as to obtain more stable and quality images.

It will be apparent to those skilled in the art that various modifications and variations can be made to the method of the present invention without departing from the scope or spirit of the invention. In view of the foregoing, it is intended that the present invention covers modifications and variations of this invention provided they fall within the scope of the following claims and their equivalents.

The invention claimed is:

1. A driving method of a liquid crystal display comprising a back-light module and a liquid crystal display panel, wherein the liquid crystal display panel has a plurality of pixels, the driving method of the liquid crystal display comprising the steps of:

dividing a plurality of grayscale values 0, 1, 2, . . . , N into a plurality of segments, where N is the highest grayscale of the image display system;

detecting a maximum grayscale X of all pixels in the present image;

adjusting output brightness of the back-light module to (Y/N)×L, where Y is upper limit of one of the segments in which the maximum grayscale X is located, L is a corresponding output brightness of the back-light module to the grayscale N, wherein the corresponding output brightness of the back-light module is retained when the grayscale maximum X is located in either a range between Y and Y+S or a range between Z-S and Z of a present image, where Z is lower limit of one of the segments in which segment the grayscale maximum X is located and S is the predetermined threshold; and adjusting a grayscale value Xa of each pixel to a mapping grayscale value Xb, and driving each of the pixels with the grayscale value Xb accordingly.

2. The driving method of the liquid crystal display as recited in claim 1, wherein a mapping correlation between the grayscale value Xa and the grayscale value Xb is linear, and the mapping correlation is performed as Xb=(Xa/Y)×N.

3. The driving method of the liquid crystal display as recited in claim 1, wherein the mapping correlation between the grayscale value Xa and the grayscale value Xb is nonlinear.

4. The driving method of the liquid crystal display as recited in claim 1, wherein light transmittance of each of the pixels is adjusted by a bias voltage based on the grayscale value Xb.

5. A driving method of a liquid crystal display comprising a back-light module and a liquid crystal display panel, wherein the liquid crystal display panel has a plurality of pixels, the driving method of the liquid crystal display comprising:

dividing a plurality of grayscale values 0, 1, 2, . . . , N into a plurality of segments, where N is the highest grayscale of the image display system, thereby the brightness of the back-light module is also divided into a plurality of values corresponding to the grayscale segments respectively;

detecting a maximum grayscale X of all pixels in the present image;

adjusting the output brightness of the back-light module to one of the plurality of values for the brightness of the back-light module, wherein the plurality of values are corresponding to the grayscale segments respectively; and adjusting a grayscale value Xa of each pixel to a mapping grayscale value Xb, and driving each of the pixels with the grayscale value Xb accordingly, wherein a mapping correlation between the grayscale value Xa and the grayscale value Xb is linear, and the nappine correlation is performed as Xb=(Xa/Y)×N, where Y is an upper limit of one of the segments in which the maximum grayscale X is located.

* * * * *